US005707213A

United States Patent [19]

Conrad

[11] Patent Number: 5,707,213

[45] Date of Patent: Jan. 13, 1998

[54] MOLECULAR VACUUM PUMP WITH A GAS-COOLED ROTOR

[75] Inventor: Armin Conrad, Herborn, Germany

[73] Assignee: Balzers-Pfeiffer GmbH, Asslar, Germany

[21] Appl. No.: 596,018

[22] Filed: Feb. 6, 1996

[30] Foreign Application Priority Data

Mar. 10, 1995 [DE] Germany ..... 195 08 566.3

[51] Int. Cl.[6] ..... F04D 19/04

[52] U.S. Cl. ..... 417/53; 417/423.4; 417/423.8; 415/177

[58] Field of Search ..... 417/423.4, 423.8, 417/53; 415/90, 116, 177

[56] References Cited

U.S. PATENT DOCUMENTS

| | | | |
|---|---|---|---|
| 4,929,151 | 5/1990 | Long et al. | 415/177 |
| 5,350,275 | 9/1994 | Ishimaru | 417/423.8 |
| 5,577,883 | 11/1996 | Schutz et al. | 415/90 |

FOREIGN PATENT DOCUMENTS

| | | | |
|---|---|---|---|
| 2408256 | 9/1975 | Germany . | |
| 2526164 | 12/1976 | Germany . | |
| 2233193 | 10/1991 | Japan | 417/423.4 |
| 4116295 | 4/1992 | Japan . | |

OTHER PUBLICATIONS

"Vacuum Physics and Techniques", Chapman & Hall, 1993, pp. 13, 14 and 29.

"Vacuumtechnik der Fa. Balzers", PM 800 049 PD, p. 9.

*Primary Examiner*—Richard E. Gluck

*Attorney, Agent, or Firm*—Anderson Kill & Olick, P.C.

[57] ABSTRACT

A method of cooling rotor elements of a molecular vacuum pump having stator and rotor elements, a suction flange defining a gas inlet, and a gas outlet spaced from the suction flange, the method including providing additional gas inlet between the suction flange and the gas outlet and admitting through the additional gas inlet a cooling gas having a thermal conductivity larger than that of the compressible gas.

6 Claims, 1 Drawing Sheet

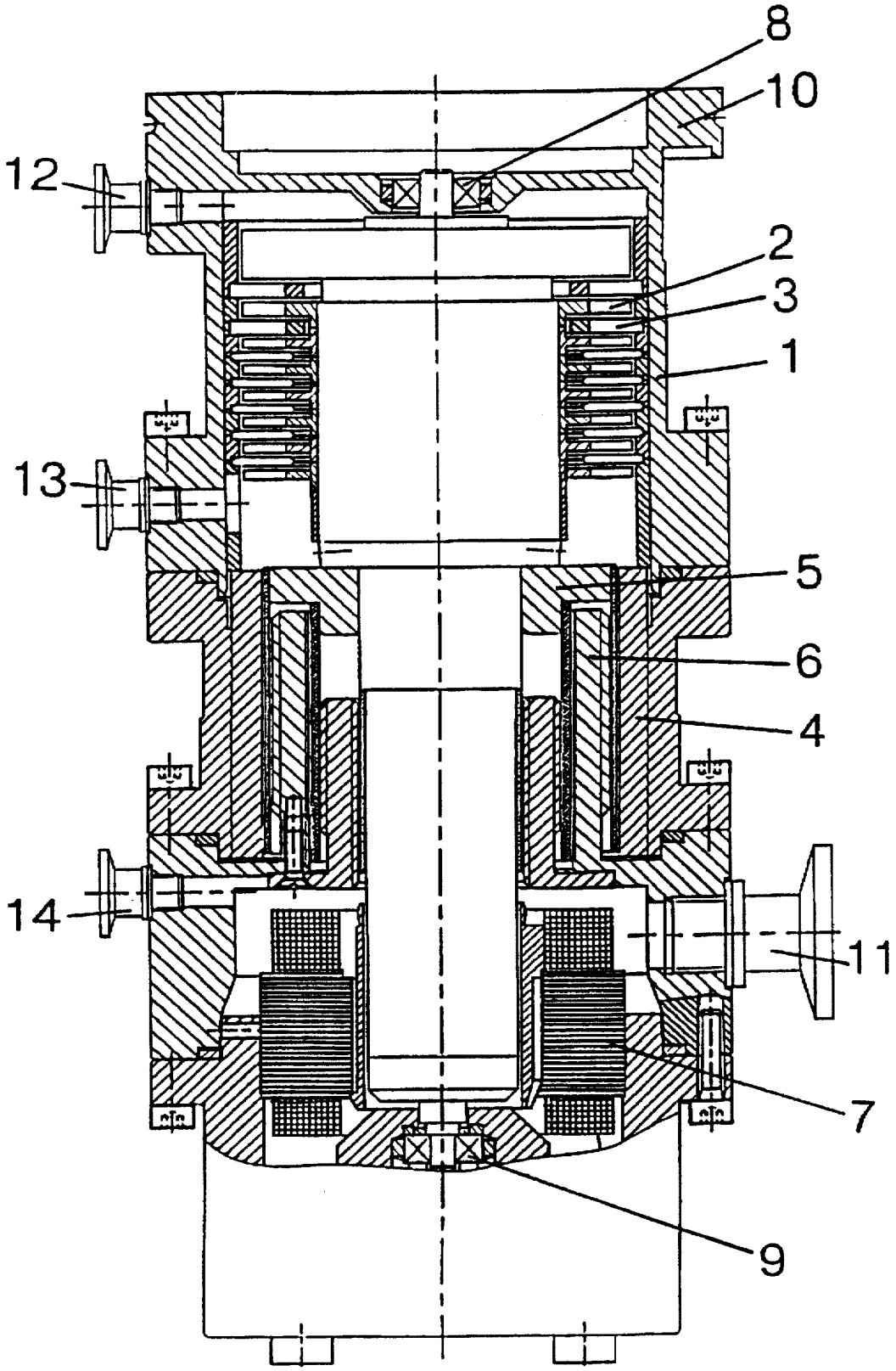
8
10
12
2
3
1
13
5
6
4
14
11
7
9

MOLECULAR VACUUM PUMP WITH A GAS-COOLED ROTOR

BACKGROUND OF THE INVENTION

The present invention relates to a molecular vacuum pump including means for delivering a cooling gas thereto and a method of cooling of a molecular vacuum pump.

As known, there exist numerous types of molecular vacuum pumps for delivering gases and for generating vacuum. The operational region, in which a molecular pump can be meaningfully used, extends from a molecular flow region, i.e., a pressure region in which mean free path lengths of gas molecules are large with respect to the geometrical dimensions of the pump, to a laminar flow region, i.e., a region in which mean free path lengths of gas molecules are small with respect to the geometrical dimensions of the pump. In this region, the gas flow may be considered as being continuum. The characteristics, which are most important for a pumping process and for a pump construction, are inner friction and thermal conductivity of the gas.

Molecular vacuum pumps are generally formed as turbomolecular pumps, especially when used in high—and ultrahigh vacuum technology. Molecular pumps, such as Siegbahn pump or Holweck pump, are suitable for use in the above-mentioned pressure region. They can be used separately or in combination with turbo molecular pumps. The operational region, which is necessary for the functioning of any molecular vacuum pump, requires that the distance between rotational and stationary parts of a pump be very small in order to keep the back stream and scavenging losses small. A common feature of all molecular pumps consists in that a pump compression ratio depends on a circumferential speed of the pump rotatable parts exponentially, and a pump suction capacity depends on the circumferential speed of the pump rotatable parts linearly. Therefore, these pumps are driven with high speed. Under these circumstances, it is critical to maintain a minimal gap between the rotor and the stator. Under this condition, a thermal expansion of the rotor plays a significant role during the pump operation. Many factors influence heating of the rotor as well as the stator. Among these factors are friction and compression, which take place during pumping of a gas, eddy current losses in the drive unit, friction losses in ball bearings or eddy current losses in magnetic bearings when the latter are used, influence of an external magnetic field, etc.

While the temperature of stator parts, which are fixedly connected with the pump housing, can be controlled by using air or water cooling, the air or water cooling is not applicable for controlling the rotor temperature. In an ideal case, the rotor is completely thermally isolated from the stator. In this case, the rotor either contactlessly supported in magnetic bearings or has only a minimal contact with stator parts, when ball bearings are used to support the rotor. The operation in vacuum prevents heat transfer by convection. The temperature equalizing results only from heat radiation. The heat radiation, however, is insufficient to insure a complete equalizing of the temperature and, besides, the heat radiation does not lend itself to a reliable temperature control.

Accordingly, the main object of the invention is a molecular pump with an effective cooling system, in particular, of the pump rotor.

SUMMARY OF THE INVENTION

This and other objects of the invention, which will become apparent hereinafter, are achieved by providing between the suction flange, which defines a gas inlet, and the gas outlet opening, an additional gas inlet for admitting a cooling gas which should have a thermal conductivity larger than that of the compressed gas.

An effective cooling of a molecular pump and, in particular, an effective heat transfer from the rotor to the stator in a molecular pump takes place when the rotor and stator parts have a large surface and are arranged close to each other. Further, to avoid an adverse effect of cooling on the regular pumping process, the admitted amount of the cooling gas should be small in comparison with the pumped gas. This requires the use of cooling gas with a high thermal conductivity.

Because the cooling gas, during the pumping process, can be seized in the pump and is also compressed, measures need be undertaken to prevent a noticeable increase of the temperature by the friction caused by the flow of the compressed cooling gas through the pump.

This requires that the inner friction of the cooling gas be small in comparison with the inner friction of the pumped gas.

In view of the foregoing requirements, first, the dependence of the thermal conductivity $\lambda$ and the inner friction $\eta$ on the molecular weight M should be considered. Generally, the thermal conductivity $\lambda$ is proportional to $1\sqrt{M}$ and the inner friction is proportional $\sqrt{M}$. Therefore, with a decreased molecular weight, the thermal conductivity increases while the inner friction decreases. Thus, gases with a small molecular weight, e.g., such as helium, are especially suitable for use as cooling gases. The more so that in general, molecular pumps are used for delivery of gases having a high molecular weight.

The amount of the cooling gas need be so selected that a maximum amount of heat is transferred. This takes place when a laminar flow region is reached. The thermal conductivity increases from a molecular flow region to a laminar flow region with increase in pressure and then becomes independent on the pressure. The laminar flow region is characterized in that the mean free path lengths of molecules are small in comparison with the geometrical dimensions of a housing walls. This means that, e.g., with a distance between rotor and stator discs of about 1 mm, the working pressure of the cooling gas is about 0.1 mbar.

The delivery of the cooling gas can be effected, in dependence on characteristics of the pump and the pumping process, at different points of the molecular pump. The advantage of providing a cooling gas inlet at the high vacuum side consists in that in this case, the maximum amount of oppositely located stator and rotor surfaces are washed with the cooling gas, and the maximum cooling effect is achieved. At that, measures need be undertaken to prevent an adverse effect of cooling on the pumping process. When cooling gases having a small molecular weight are used and which, because of specific characteristics of the molecular pump, have a small compression ratio, providing a cooling gas inlet at the high vacuum side only then makes sense when the pump itself has a particular high compression characteristic. These ratios are less critical when the cooling gas is admitted at the forvacuum side. In this case, substantially smaller opposite stator and rotor surfaces are washed with the cooling gas, but the cooling gas is admitted in a pressure region in which the thermal conductivity has already achieved its maximum. At that, an additional advantage consists in that the already available flashing gas flange at this location can be used. In this case, the cooling gas can be added to the flashing or scavenging gas. By admitting the gas between the above-mentioned two locations, dependent on the pump type and the pumping process, the above-mentioned advantages can be more completely used and drawbacks be eliminated.

The cooling means and the cooling method according to the present invention enable to so cool the rotor of a molecular pump, dependent on the characteristics of the pump and the pumping process, that even in extreme cases, the temperatures can be retained at the maximum allowable values.

BRIEF DESCRIPTION OF THE DRAWINGS

The features and objects of the present invention will become more apparent, and the invention itself will be best understood from the following detailed description of the preferred embodiments when read with reference to the accompanying drawings, wherein:

Single FIGURE shows a cross-sectional view of molecular vacuum pump with a gas-cooled rotor according to the present invention.

DETAILED DESCRIPTION OF THE PREFERRED EMBODIMENT

The molecular vacuum pump, which is shown in the drawings, represent, by way of example, a combination of a turbomolecular 1, having rotor discs 2 and stator discs 3, and a Holweck pump 4 having rotatable parts 5 and stationary parts 6. Both the turbomolecular pump 1 and the Holweck pump 4 have a common drive 7 and common bearings 8 and 9. The high vacuum side of the combination pump is provided with a connection or suction flange 10. The molecular vacuum pump has a gas outlet opening 11. The cooling gas can be admitted, selectively, at any of the inlets 12, 13 or 14. The inlets 13 and 14 can simultaneously be used for admittance of the scavenging gas. The admittance of the cooling gas at the high vacuum side can be effected as through the inlet 12 so through the connection or suction flange 10.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A method of cooling a molecular vacuum pump for compressing gases and having stator means, rotor means, a suction flange defining a gas inlet, and a gas outlet spaced from the suction flange, said method comprising the steps of:

providing an additional gas inlet between the suction flange and the gas outlet; and admitting through the additional gas inlet a cooling gas for cooling the rotor means and having a thermal conductivity larger than a thermal conductivity of a compressible gas.

2. A method as set forth in claim 1, wherein said cooling gas admitting step comprises the step of admitting a cooling gas characterized by an inner friction which is smaller than an inner friction of the compressible gas.

3. A method as set forth in claim 1, wherein said cooling gas admitting step comprises the step of admitting a cooling gas having a molecular weight smaller than a molecular weight of the compressible gas.

4. A method as set forth in claim 1, further comprising the step of admitting a flashing gas through the additional gas inlet.

5. A method as set forth in claim 1, wherein the additional gas inlet providing step comprises providing the additional gas inlet at one of the high vacuum side of the pump.

6. A method as set forth in claim 1, wherein the additional gas inlet providing step comprises providing the additional gas inlet between the high vacuum side of the pump and a for vacuum side of the pump.

* * * * *